US005794316A

United States Patent [19]

Anscher

[11] Patent Number: 5,794,316

[45] Date of Patent: Aug. 18, 1998

[54] SIDE-RELEASE BUCKLE HAVING IMPROVED LOCKING FEATURE

[75] Inventor: Joseph Anscher, Muttontown, N.Y.

[73] Assignee: National Molding Corp., Farmingdale, N.Y.

[21] Appl. No.: 669,190

[22] Filed: Jun. 24, 1996

[51] Int. Cl.[6] ..... A44B 11/25

[52] U.S. Cl. ..... 24/625; 24/615

[58] Field of Search ..... 24/625, 614, 615

[56] References Cited

U.S. PATENT DOCUMENTS

| | | | |
|---|---|---|---|
| 4,150,464 | 4/1979 | Tracy | 24/77 R |
| 4,779,315 | 10/1988 | Kohus | 24/625 X |
| 4,831,694 | 5/1989 | Kong | 24/615 X |
| 5,222,279 | 6/1993 | Frano et al. | 24/625 |
| 5,379,496 | 1/1995 | Krauss | 24/615 X |
| 5,380,067 | 1/1995 | Turvill et al. | 24/615 X |
| 5,548,879 | 8/1996 | Wu | 24/625 |

*Primary Examiner*—Peter M. Cuomo
*Assistant Examiner*—Stephen Vu
*Attorney, Agent, or Firm*—Kenyon & Kenyon

[57] ABSTRACT

A side release buckle having an improved locking mechanism includes a male plug member and a female socket member. The plug member has a pair of resiliently flexible arm members. Each arm member defines a generally V shaped latching surface arranged around the top, bottom and outer side of the arm member. The V shaped latching surface is adapted to engage a complimentary V shaped engagement surface in the socket member when the plug member is fully inserted into the socket member. The V shape of the latching surface allows the latching surface area to be more uniformly distributed around the top, bottom and outer side of the arm member.

12 Claims, 4 Drawing Sheets

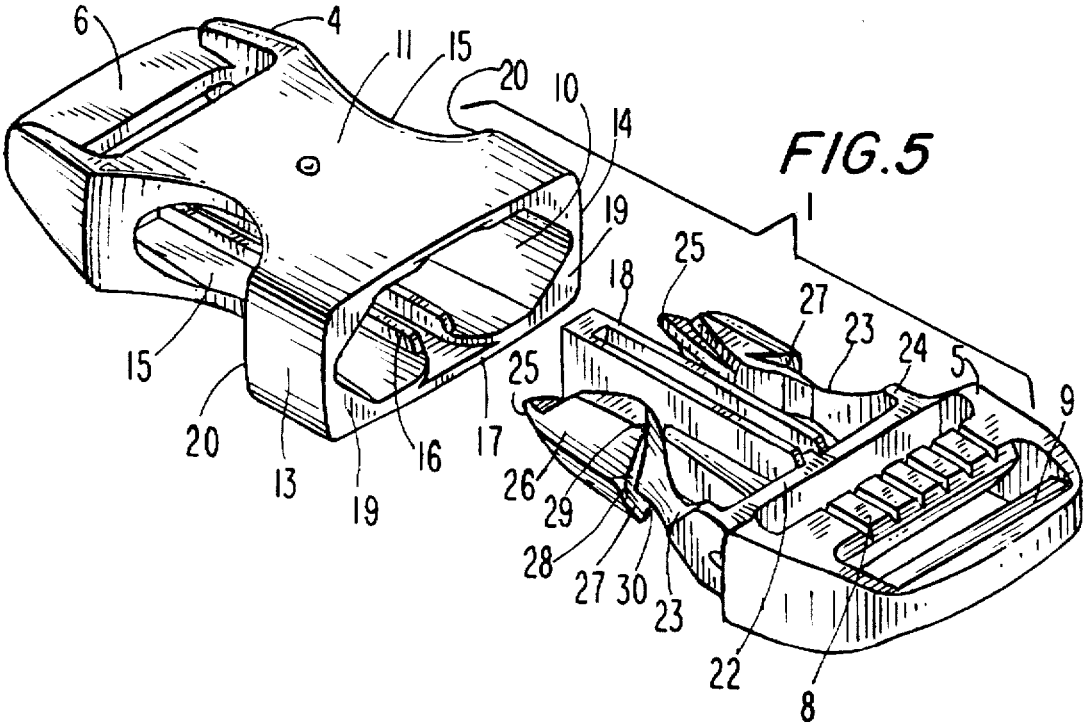
FIG.5
FIG.6
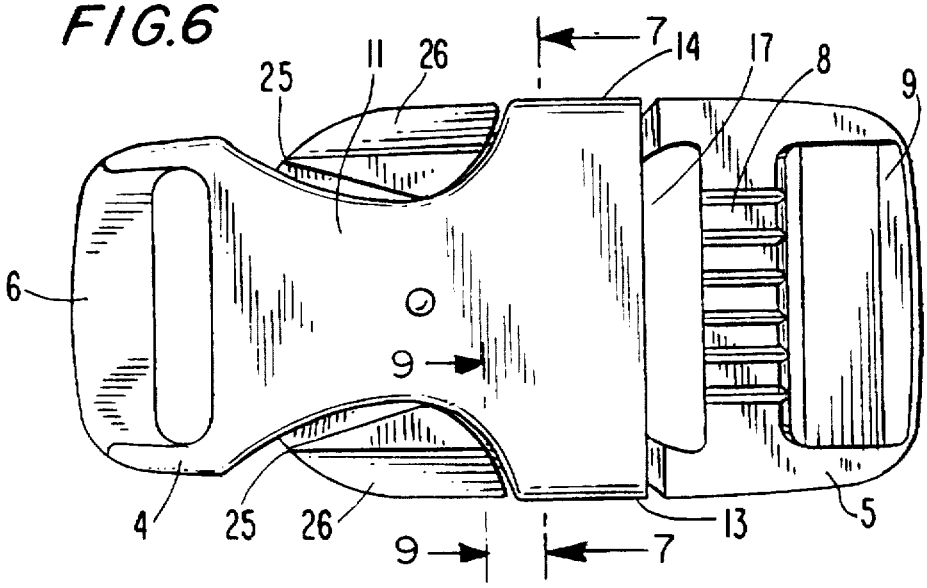

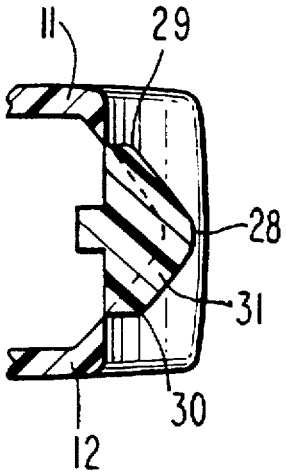
FIG.9
FIG. 10
PRIOR ART
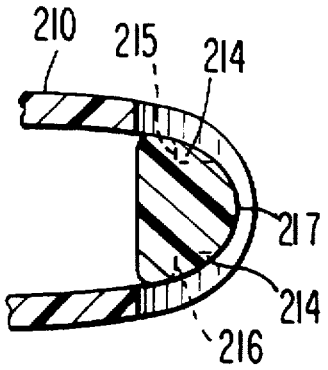
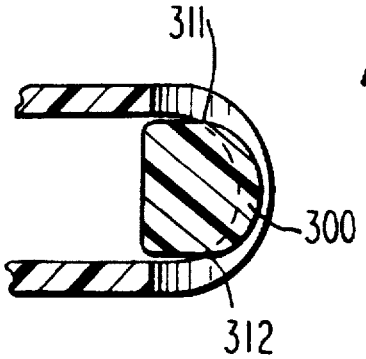
FIG. 11
PRIOR ART

SIDE-RELEASE BUCKLE HAVING IMPROVED LOCKING FEATURE

BACKGROUND OF THE INVENTION

1. Field of the Invention

The invention relates generally to side-release buckles of the type having a female receptacle member and a mating male latch member which are releasably lockable together. More particularly, the invention relates to such a side-release buckle wherein the male member includes a generally V shaped latching surface around its arms which engages a complimentary V shaped engaging surface in the female member for increased latching strength.

1. Description of Related Art

Assorted two-piece buckles are known in the art. These buckles typically include a female receptacle or socket member which is engageable with a male latch or plug member. One or both of the members adjustably or fixedly holds a strap or belt around crossbars or the like. One particularly common form of a two-piece buckle is one in which the plug member includes a pair of arms which, when inserted into the socket member, flex inwardly and slide past opposing stop members in the socket until they snap fit into respective side openings in the socket. The stop members are typically inwardly projecting surfaces of the socket member around the periphery of the opening which engage with shoulders defined on the outside edges of the arms of the male member. The two buckle pieces are unlocked and disengaged by squeezing the legs of the male member through the openings in the female member between the thumb and forefinger, thereby freeing the shoulders defined in the arms from the respective stop members in the female member and allowing the two buckle pieces to become separated.

An example of such a buckle is disclosed in U.S. Pat. No. 4,150,464, and a basic configuration of this type of buckle is illustrated in FIGS. 3 and 4. It can be seen that the female member defines apertures in opposing side walls thereof for engagement with shoulders of the latch arms belonging to the male member. The shoulders are positioned on the outside side surfaces of the latch arms and engage the stop members which project inwardly from the side walls of the female member. However, it has been recognized that with this arrangement, the buckle is susceptible to failure during heavy loading for the following reasons. The load in the latch arms which urges removal of the latch arms from the female member is ordinarily directed along the longitudinal axis or center line X of each latch arm. However, the line Y, which represents the location of the latch resistance or engagement force opposing the load, is offset from center line X because it is directed between the side walls of the female member and the shoulders on the outside side surfaces of the latch arms. Accordingly, it has been recognized that during loading on the buckle, a torque develops between the latch arms and the female member which tends to cause inward rotation of the latch arms in the direction of arrow Z (see FIG. 4), and consequently release of the buckle (see also U.S. Pat. No. 5,222,279 (col. 1, l. 43–48).

U.S. Pat. No. 5,222,279 proposes a solution to this problem. In accordance with this patent, the shoulders on the latch arms are relocated from the outside side surfaces thereof to the top and bottom surface of each arm (see FIGS. 1 and 2). Thus, each arm has a pair of shoulders on opposite top and bottom sides of the arm (i.e., the top and bottom of the arm), and the shoulders are on opposite sides of the longitudinal axis or central line of each latch arm. The shoulders engage corresponding stop members in the female member of the buckle. Since the shoulders are no longer positioned on the outside side surfaces of the latch arms, and since the shoulders are supposedly aligned with the central or longitudinal axis of the latch arms, the latch resistance force which opposes the load on the buckle is supposedly aligned with the load force.

However, the shoulders on the latch arms of the buckle described in U.S. Pat. No. 5,222,279 are located only on the top and bottom of the latch arms, and they do not extend around the outer side of the latch arms as in U.S. Pat. No. 4,150,464. Therefore, only a relatively small shoulder surface engages the stop members in the female member of the buckle. Furthermore, the stop members in the female member of the buckle are thin walled projections which can break when subjected to a considerable load. For these reasons, the latching strength or holding power of the buckle of U.S. Pat. No. 5,222,279 may not be as strong as necessary for very heavy load applications.

In accordance with another prior art buckle which is a hybrid of the buckles of U.S. Pat. No. 4,150,464 and 5,222,279, the shoulder on the latch arm is U shaped and wraps completely around the top, bottom and outer side of the latch arm. Although this buckle increases the surface area of the shoulder which latches onto the complimentary stop member in the female member as compared to the buckles of the above-referenced patents, most of the latching surface area is on the outer side of the latch arm, as in U.S. Pat. No. 4,150,464, rather than on the top and bottom of the latch arm, as in U.S. Pat. No. 5,222,279. This uneven distribution of the latching surface area is attributable to the U shape of the shoulder, because the latching surface must become continuously thinner towards the two ends of the U (i.e., located on the top and bottom of the arm) in order to allow room for the arms to be inserted into the female member of the buckle. This is because the arms are not flexible in the top to bottom direction so that the arms cannot flex to allow significant shoulders on the top and bottom to pass by the stop members in the female buckle piece. Another drawback to this prior art is that the stop members in the female buckle member are thin walled projections which can break when subjected to considerable load.

It would therefore be desirable to provide a side release buckle wherein the latching surface area of the shoulder is evenly distributed around the top, bottom and outer side of the arm for achieving greater latching strength and holding power of the buckle. It would also be desirable to eliminate the stop member design of the prior art, wherein a wall or projection overhangs into the cavity of the female member, and replace this design with a locking surface which is completed supported and integrated into the housing of the female member itself.

SUMMARY OF THE INVENTION

Accordingly, it is an object of the invention to provide a side-release type buckle wherein the latching surface area of the shoulder is evenly distributed around the top, bottom and outer side of the arm for achieving greater latching strength and holding power of the buckle.

It is another object of the invention to provide a side-release type buckle wherein the mating locking surface of the female buckle piece is completely integrated and fully supported in the female housing thereby having increased strength as compared to the overhanging stop projections in the female buckle piece of the prior art.

It is a further object of the invention to provide a side-release buckle having an improved locking mechanism as compared to the side-release buckles of the prior art.

These and other objects of the invention, which will become apparent from the following Detailed Description of the Invention, are achieved by a side-release buckle having the following structure.

The invention is a side-release type buckle having a female socket member which defines a socket or receptacle therein having an open end. A male latch or plug member having at least one arm for insertion into the socket through the open end of the female member is provided. The plug member includes at least one resiliently flexible arm projecting from a base thereof which is adapted to be inserted into the socket member. A region at or near the distal end of the arm(s) defines a protrusion on the outside side surface of the arm. The protrusion defines a generally V shaped shoulder which extends around the top, bottom and outer side of the arm, with the apex of the V located on the outer side of the arm and the two ends of the V located on the top and bottom of the arm.

The female socket member includes at least one aperture defined through a side wall thereof for exposing the protrusion of the arm belonging to the plug member, when the plug member is fully inserted into the socket member. The side wall of the socket member which is distal to the aperture defined in the side wall is integrally formed with a generally V shaped stop member which is adapted to engage with the V shaped shoulder defined in the arm of the male member when the male and female buckle pieces are-coupled. In a preferred embodiment of the invention, the stop member extends from the aperture all the way to the distal end of the female member for increased strength.

To separate the two buckle pieces, the protrusions of the arms are merely pushed inward into the aperture in the side walls of the socket until the shoulders clear the stop members. The resilient force now supplied by the inwardly flexed arms will urge the plug member to spring out of the socket member, thereby disengaging the buckle pieces.

BRIEF DESCRIPTION OF THE DRAWINGS

Various other objects, features and advantages of the present invention will be more fully appreciated from the following detailed description of the preferred embodiments, when considered in connection with the accompanying drawings, in which like reference characters designate like or corresponding parts throughout the several views, and wherein:

FIG. 5 is an exploded perspective view of a buckle in accordance with the invention.

FIG. 6 is an elevational view of the top of the buckle of FIG. 5 in the coupled or locked state.

FIG. 9 is an isolated cross-sectional view of the V shaped locking feature of the invention taken along the line 9—9 of FIG. 6. FIG. 10 is an isolated cross-sectional view, corresponding to the view of FIG. 9, of the locking feature of the prior art buckle of U.S. Pat. No. 5,222,279 taken along the line 10—10 of FIG. 2.

FIG. 11 is an isolated cross-sectional view, L corresponding to the view of FIG. 9, of the locking feature of the prior art buckle which is a hybrid of the buckles of U.S. Pat. No. 5,222,279 and 4,150,464, having a U shaped latching shoulder.

DETAILED DESCRIPTION OF THE INVENTION

Figure 1:
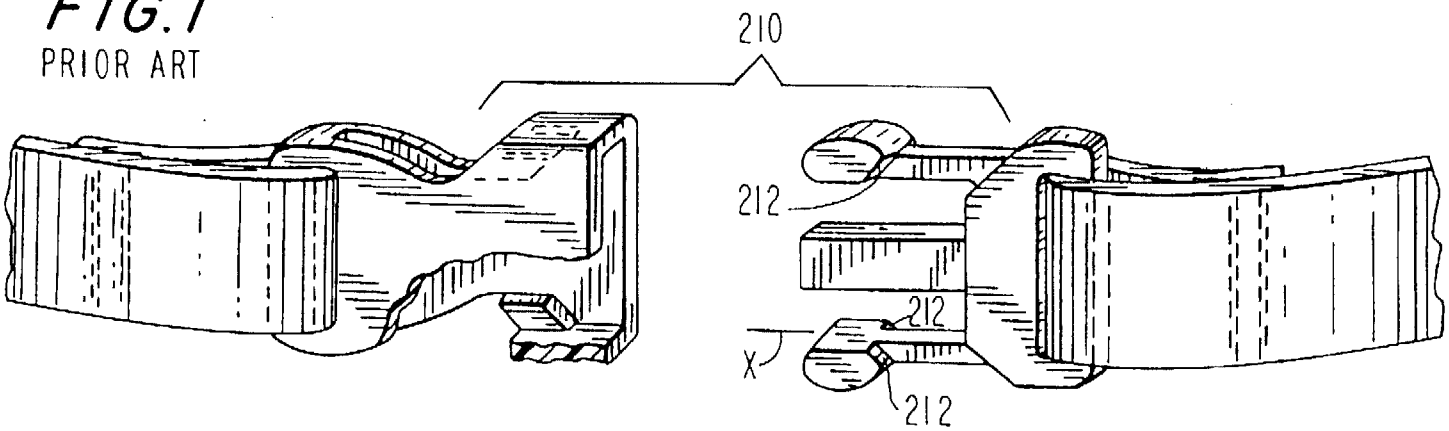
FIG. 1 PRIOR ART
FIG. 1 is an exploded perspective view of a side release type buckle of the prior art showing the male and female members separated.

Referring to FIGS. 5–9, a buckle in accordance with a first embodiment of the invention is designated generally by the reference numeral 1. The buckle 1 is typically used to connect free-ends of straps (not illustrated). The buckle 1 is generally comprised of two pieces, a female socket member 4 and a complementary male plug member 5.

The buckle 1 is preferably molded from some type of plastic or resin, but any suitable material known in the art for molding or machining side-release type buckles may be used.

The socket member 4 includes a single cross bar 6 at its proximal end. A strap (not illustrated) can be looped around the cross bar 6 and then stitched to itself to permanently secure the strap to the cross bar. The male plug member 5 includes a pair of cross bars 8 and 9 at its proximal end which can receive a strap in a well known manner such that the strap is adjustable, for example, as described in my U.S. Pat. No. 5,216,786. Alternatively, the pair of cross bars may be provided on the female socket member and the single cross bar may be provided on the male member, or both the male and the female members may include a single cross bar, in which event no straps would be adjustable.

The socket member 4 preferably has a flat rectangular tubular cross-sectional configuration as illustrated in FIG. 5, having a substantially rectangular shaped interior cavity 10. The cavity 10 is defined as the area between a top wall 11, an opposing bottom wall 12 and a pair of side walls 13 and 14, each of which connects the top wall to the bottom wall at the side edges thereof. The top and bottom walls 11 and 12 are typically much wider than the side walls 13 and 14, as illustrated, so that the socket member has a substantially flat or rectangular shape.

As will be explained in detail below, the male plug member 5 is received and releasably locked within the cavity 10 of the female socket member 4 via latching surfaces defined on shoulders which are associated with the male member. The female socket member 4 includes an aperture 15 defined in each side wall 13 and 14 thereof. The apertures 15 cooperate with the latching surfaces associated with the male plug member 5 to retain and lock the plug member 5 within the socket member 4. The apertures 15 also enable the user to access the male plug member 5 from the exterior of the socket member 4 to allow for release of the two buckle pieces (see FIGS. 6 and 8). Each aperture 15 extends at least through a portion of the top and bottom walls 11 and 12, as well as through the opposing side walls 13 and 14, to form a side-release type buckle 1. However, as will be appreciated by those skilled in the art, the particular shape, location, position and number of apertures-15 can vary so long as the side-release buckle 1 functions substantially as described herein.

To facilitate in guiding the male plug member 5 as it is inserted into the cavity 10 of the socket member 4, the inner surfaces of the top and bottom walls 11 and 12 of the socket member 4 may be formed with a pair of inwardly projecting guides 16 (see FIG. 7) which extend from the distal end 17 (i.e., the open end) of the socket member toward the proximal end near the cross bar 6. The area between the guides 16 will receive a distally projecting and centrally disposed guide bar 18 on the male plug member 5 as will be described hereinafter.

To retain and lock the plug member 5 in the socket member 4, the inner surface of walls 11, 12 and 13 and 11, 12 and 14 form a generally V shaped cross section which defines a stopping member 19. Consequently, each stopping member 19 is generally V shaped with the apex of the V pointing toward the side wall 13 (or 14) and the two ends of the V located near the top wall 11 and bottom wall 12, respectively. The proximal end of each stopping member 19 (i.e., the end of the stopping member closest to the aperture 15) defines an engaging surface 20, having the same V shape as the stopping member 19, the function of which is explained hereinafter.

Each stopping member 19 is positioned adjacent to or near the distal end of the aperture 15 in the side wall 13 or 14. Preferably, the stopping member 19 extends continuously from the distal end of the aperture 15 all the way to the distal end 17 of the socket member so that the stopping member is an integral part of the side wall 13 or 14 to which it belongs (see FIG. 5). This integral configuration is strongly preferred over one in which the stopping member 19 is simply an inward projection from the side wall because it has greatly increased strength.

The male plug member 5 includes a proximal base portion 22 which is attached to two resiliently flexible arm members 23. Arm members 23 project in the distal direction from the base 22. The pair of arm members 23 have a predetermined length, and run along opposite sides of the male plug member 5. Guide bar 18 (if provided) also projects in the distal direction from the base 22.

Each arm member 23 includes a first proximal end 24 which is attached to the base portion 22 and a second opposite distal end 25. To facilitate access to the user of the buckle, the distal end 25 of each arm member 23 is formed with a protrusion or bulbous region 26 on its outer side surface. The proximal end of each protrusion defines a shoulder-latching surface 27. As illustrated in FIG. 5, the shoulder-latching surface 27 is generally V shaped. The apex 28 of the V shaped shoulder is positioned on the outer side of the arm protrusion 26, and the two ends of the V shaped shoulder are positioned at the top 29 and bottom 30 of the arm. Thus, the shoulder 27 extends around the top, bottom and outer side of each arm 23.

The shoulder 27 should be positioned along the arm 23 at a predetermined point such that it engages the proximal end 20 of the V shaped stopping member 19 when the plug member 5 is fully inserted into the socket member 4.

To releasably connect the male plug member 5 to the socket member 4, the distal end 25 of each arm member 23 is first inserted within the cavity 10, with the guide bar 18 being positioned within the guides 16 of the socket member 4. Upon continued insertion, the distal ends 25 and protrusions 26 of each arm will contact the stopping members 19, and each arm member 23 will be flexed toward the interior of the cavity 10. Further insertion will result in the shoulders 27 moving beyond the proximal end 20 of the stopping member 19 and into the aperture 15, at which point each arm member 23 snaps outward with respect to the cavity 10. In this position, the proximal end 20 of the V shaped stopping member engages the shoulder- latching surface 27. (See in FIG. 6 where the V-shaped engagement is illustrated in phantom line). It can be seen from FIGS. 6 and 8 that in this locked position, the protrusion 26 of each arm extends out from the sides of the socket member through the apertures 15.

To release the male plug member from the cavity 10, a user presses the protrusions 26 through apertures 15 into the cavity 10 to flex the arm members 23 inward with respect to the cavity 10. Once the shoulders 27 on the arms 23 clear the engagement surfaces 20 of the stopping members 19, the male plug member can be removed from the socket member. The resilient force exerted by the arm members so flexed inwardly will facilitate the "springing out" of the plug member from the cavity 10. In addition, the rounded outside side surfaces of the protrusions 26 will also facilitate easy separation of the plug member 5 from the socket member 4.

Figure 3:
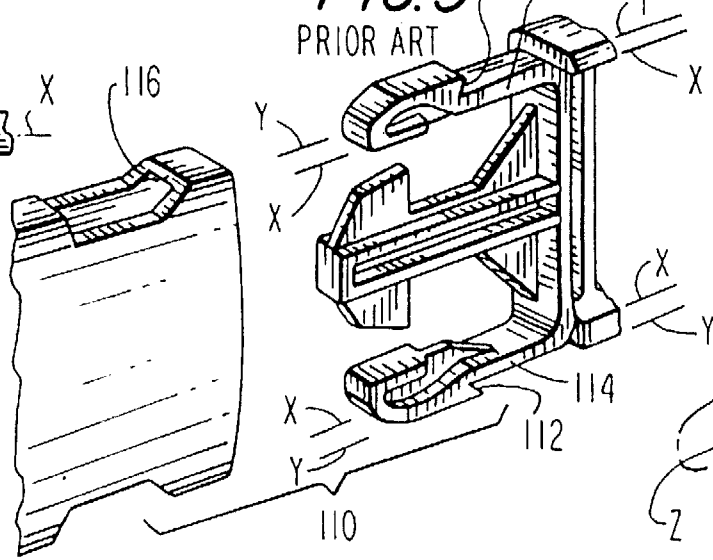
FIG. 3 PRIOR ART
FIG. 3 is an exploded perspective view of another prior art buckle showing the female and male members separated.
Figure 4:
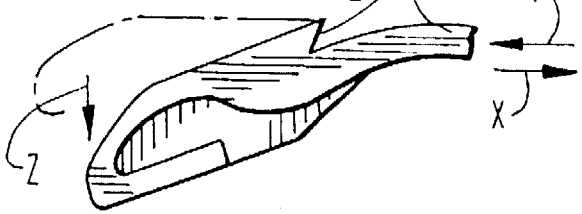
FIG. 4 PRIOR ART
FIG. 4 is an enlarged isolated view of a portion of the prior art buckle of FIG. 3, illustrating the engagement and failure positions between the male and female members.
Figure 7:
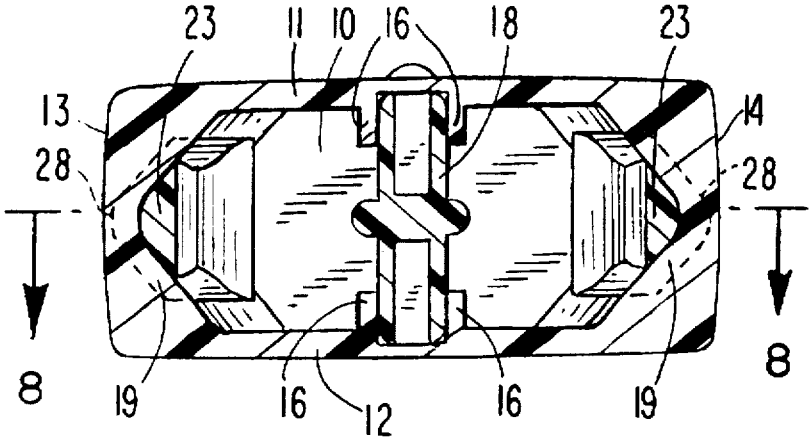
FIG. 7 is a cross-sectional view of the buckle of FIG. 6 taken along the line 7—7 which, in phantom, illustrates the V shaped engagement of the latches with the stopping members.
Figure 8:
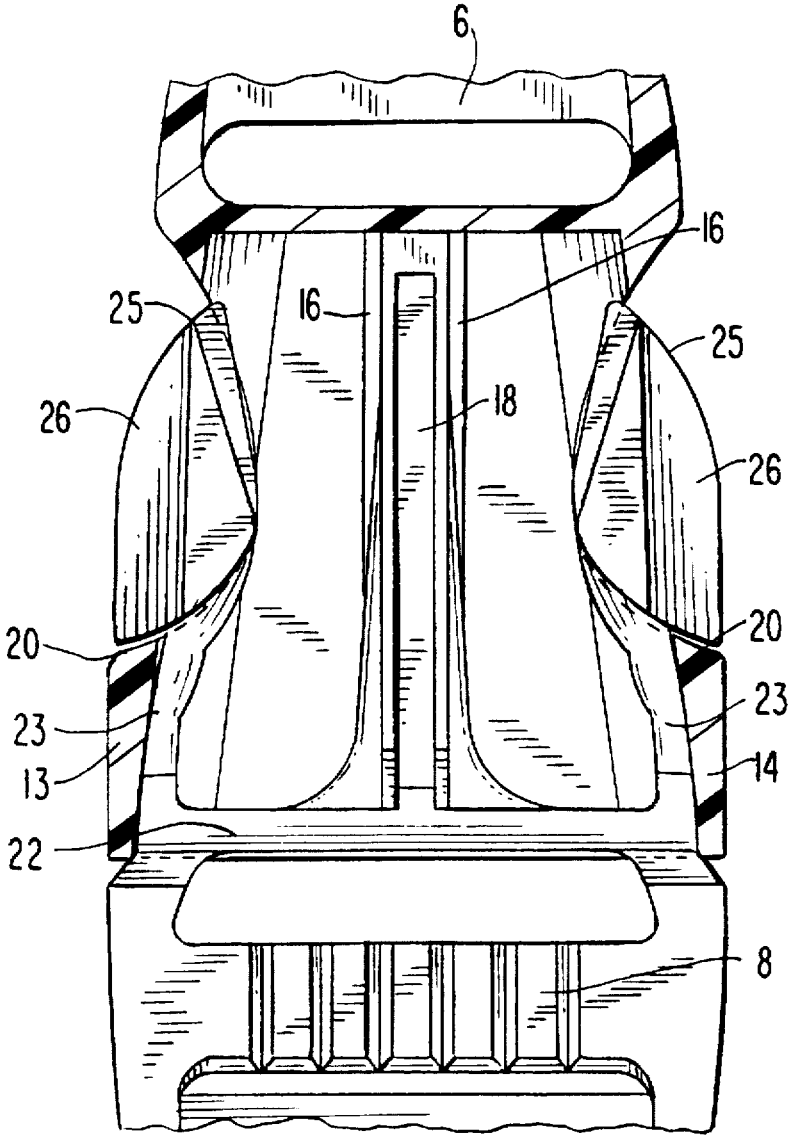
FIG. 8 is a cross-sectional view of the of the buckle illustrated in FIG. 7 taken along the line 8—8.

As described earlier, the prior art buckle 110 illustrated in FIGS. 3 and 4 includes shoulders 112 located only on the outer sides of the arm members 114 of the male latch member. Accordingly, the force provided under load is centered along line "X", which runs through the longitudinal center line or axis of each arm member 114, while the engagement or retaining force provided by the shoulders 112 is centered along line "Y", which runs through the shoulders 112 and is slightly offset from the line "X". The offset between lines "X" and "Y" produces a torque on the arm members 114 substantially in the direction of arrow "Z" in FIG. 4 causing premature unlocking of the arm members 112 from the stop members 116 and/or release of the buckle 110.

Figure 2:
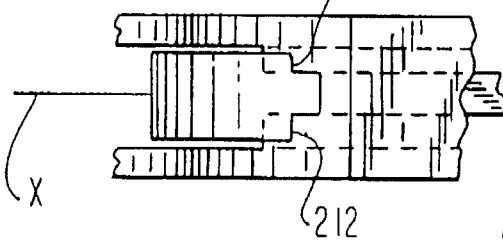
FIG. 2 PRIOR ART
FIG. 2 is an isolated enlarged side elevational view of the locking mechanism of the prior art buckle of FIG. 1 wherein the male and female members are coupled.

In the buckle 210 of U.S. Pat. No. 5,222,279 (illustrated in FIGS. 1, 2 and 10), the shoulders 212 which supply the engagement or retaining force are situated on the top 215 and bottom 216, but not on the outer side 217, of each arm. The shoulders are supposedly aligned with the longitudinal axis "X" of the arm member. However, as discussed above, this buckle provides only a very small latching surface area because the shoulders 212 are situated only on the top 215 and bottom 216 of each arm and not along the outer sides 217 of the arms (see FIG. 10). The small latching surface area 214, which is the area of engagement of the shoulders on the arms with the mating stop projections in the female buckle piece, is best seen in FIG. 10.

Finally, as discussed above, there exists a hybrid prior art buckle which includes a U shaped latching surface extending around the top, bottom and outer side of each arm (see FIG. 11). However, in this buckle the latching surface area 300 (i.e., the area of engagement of the shoulders on the arms with the mating stop members in the female buckle piece) is not evenly distributed around the arm. Because of the U shape of the latch surface, the sections of latch surface situated at the top 311 and bottom 312 of the arm (i.e. , at the ends of the U) necessarily taper off so that there is adequate room for insertion of the arms into the socket member of the buckle. This is because the arms can only flex in the side to side direction, not in the top to bottom direction, so that significant shoulders on the top and bottom of the arm could not clear corresponding stop members in the socket member of the buckle. Hence, only a very small latching surface area at the top and bottom of each arm is available for latching onto a corresponding engagement surface in the female member of the buckle, and most of the latching surface area is situated along the outer sides of the arms (see FIG. 11).

In contrast, as FIG. 9 illustrates, the buckle of the present invention provides a latching surface area 31 (i.e., the area of engagement between the shoulder-latching surface 27 and the proximal end engagement surface 20 of stopping member 19) which is more evenly distributed around the top 29, bottom 30 and outer side 28 of each arm. This more even distribution of the latching surface area 31 around the top 29, bottom 30 and outer side 28 of each arm is possible due to the generally V shape of the shoulder-latching surface 27 and the complimentary V shape of the engagement surface 20 of the stop member 19. Unlike the U shaped latching surface of the hybrid prior art, the V shaped latching surface of the invention does not taper off to a significant extent in the direction towards the two ends of the V (see FIG. 9). In this way, the latching surface area provided at the top 29 and bottom 30 of each arm is not disproportionately less than the latching surface area provided at the outer side 28 of the arm (i.e., at the apex of the V).

Therefore, it can be seen that the present invention affords a latching surface area which is relatively evenly distributed around the top, bottom and outer side of each arm, for more uniformly distributed latching surface area than the prior art. This is attributable to the fact that the latching surface area 31 will always constitute the difference of the outside of the latch on the arm and the inside of the female housing, which basically are both V shaped and basically have a nominal dimension along the entire V area.

Another advantage afforded by the invention is as follows. Because of the corresponding V shapes of the shoulders on the arms and the engagement surfaces integral in the female housing, the strength of the buckle could be continuously increased by expanding the overall thickness of the housing and the shoulders, and yet by the very nature of the relationship of the two shapes the amount of inward movement of the arms required to release the buckle will always remain the same. However, if the corresponding latching and engagement surfaces of the prior art buckles of FIGS. 1–4 and 10–11 are increased in size, the arms of the male member would have to be pushed inward to a greater extent to clear the latching surfaces from the engagement surfaces and release the buckle.

In other words, the nature of the V design is such that it defines a progressive opening of the female housing, which corresponds to a progressive thickening of the V shaped shoulders on the arms. Consequently, to either strengthen the buckle retaining force or progressively increase the load area interior to the buckle will in no way change the ease of release or insertion of the buckle because the inward movement of the arms required to clear the latching surfaces from the engagement surfaces will always remain constant. On the other hand, in order to accomplish either of these increased strength characteristics in the prior art buckles, one would need to increase the inward projection of the stopping members which overhang in the cavity of the female buckle piece. The disadvantage of this is that a greater inward stroke of the arms would be required for insertion and release of the buckle.

In the preceding specification, the invention has been described with reference to specific exemplary embodiments thereof. It will, however, be evident that various modifications and changes may be made thereunto without departing from the broader spirit and scope of the invention as set forth in the claims which follow. The specification and drawings are accordingly to be regarded in an illustrative rather than a restrictive sense.

What is claimed is:

1. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having at least one arm member for insertion within said cavity of said socket member through said open end of said cavity, said at least one arm member having a top surface, a bottom surface, an outer side surface and an inner side surface;

an essentially V shaped latching surface defined in said arm member, said latching surface extending from an apex situated on the outer side surface of the arm member in a direction toward the inner side surface of the arm member to a pair of ends which are situated on the top and bottom of the arm member;

a locking surface integrated in at least one of said side walls of said socket member, the locking surface defining an essentially V shaped engagement surface, said engagement surface being adapted to engage said latching surface on said at least one arm member when said at least one arm member is inserted into the open end of said cavity to couple the plug member to the socket member, whereby the surface area of engagement of the latching surface with the engagement surface is essentially uniformly distributed around the top, bottom and outer side surface of said at least one arm member when the plug member is coupled to the socket member;

means for disengaging the latching surface from the engagement surface to permit decoupling of the plug member from the socket member; and means for coupling a belt to at least one of the plug member or the socket member.

2. The buckle according to claim 1 having two arm members, the arm members running along opposite sides of the plug member.

3. The buckle according to claim 1 wherein the means for disengaging includes a protrusion along the outer side surface of said at least one arm member and an aperture defined in said at least one of said side walls of said socket member, whereby said protrusion is exposed through said aperture when said plug member is coupled to said socket member.

4. The buckle according to claim 3 wherein said latching surface is defined on a proximal end face of said protrusion.

5. The buckle according to claim 4 wherein said locking surface extends from a distal end of said aperture to a distal end of the socket member.

6. The buckle according to claim 5 having two arm members, each arm member running along opposite sides of the plug member.

7. The buckle according to claim 3 wherein said locking surface extends from a distal end of said aperture to a distal end of the socket member.

8. The buckle according to claim 1 wherein said at least one arm member has a predetermined thickness between said outer side surface and said inner side surface, and wherein said latching surface extends through a longitudinal axis situated midway between said outer side surface and said inner side surface.

9. The buckle according to claim 8 wherein the means for disengaging includes a rounded protrusion along the outer side surface of said at least one arm member and an aperture defined in said at least one of said side walls of said socket member, whereby said rounded protrusion is exposed through said aperture when said plug member is coupled to said socket member.

10. The buckle according to claim 9 wherein said locking surface extends from a distal end of said aperture to a distal end of the socket member.

11. The buckle according to claim 9 wherein said latching surface is defined on a proximal end face of said protrusion.

12. The buckle according to claim 11 wherein said locking surface extends from a distal end of said aperture to a distal end of the socket member.

* * * * *